US005472049A

United States Patent [19]

Chaffee et al.

[11] Patent Number: 5,472,049

[45] Date of Patent: Dec. 5, 1995

[54] HYDRAULIC FRACTURING OF SHALLOW WELLS

[75] Inventors: Brent F. Chaffee, Yorba Linda; Brian J. Kelly, Corona; Jeffery W. Koepke, Orange, all of Calif.; Michael J. Kirby, Kent, Wash.

[73] Assignee: Union Oil Company of California, Los Angeles, Calif.

[21] Appl. No.: 230,325

[22] Filed: Apr. 20, 1994

[51] Int. Cl.[6] ..... E21B 33/124; E21B 43/26; E21B 43/267

[52] U.S. Cl. ..... 166/250.1; 166/50; 166/177.5; 166/191; 166/308

[58] Field of Search ..... 166/308, 271, 166/250, 298, 297, 280, 50, 191, 55.7, 177

[56] References Cited

U.S. PATENT DOCUMENTS

| | | | |
|---|---|---|---|
| 3,712,379 | 1/1973 | Hill | 166/308 X |
| 4,779,681 | 10/1988 | York | 166/308 X |
| 4,974,675 | 12/1990 | Austin et al. | 166/250 |
| 4,977,961 | 12/1990 | Avasthi | 166/308 X |
| 5,010,527 | 11/1988 | Mahrer | 367/86 |
| 5,111,881 | 5/1992 | Soliman et al. | 166/308 X |
| 5,249,628 | 10/1993 | Surjaatmadja | 166/308 |
| 5,335,724 | 8/1994 | Venditto et al. | 166/308 X |
| 5,372,195 | 12/1994 | Swanson et al. | 166/308 |

OTHER PUBLICATIONS

"Some Recent Developments In Delivery and Recovery: Hydraulic Fracturing and Directional Drilling", by Larry Murdoch, Proceedings of ETEX '92—The 2nd Annual Environmental Technology Exposition and Conference, Washington D.C. USA, Apr. 7–9, 1992.

SPE 26169, "Inflow Performance and Production Forecasting of Horizontal Wells With Multiple Hydraulic Fractures in Low–Permeability Gas Reservoirs", by G. Guo and R. D. Evans.

SPE 26167, "Identification and Potential Treatment of Near–Wellbore Formation Damage in a Horizontal Gas Well", by A. K. M. Jamaluddin and L. M. Vandamme.

SPE 17759, "Hydraulic Fracturing of a Horizontal Well in a Naturally Fractured Reservoir: Gas Study for Multiple Fracture Design", by A. B. Yost, II, W. K. Overbey, Jr., D. A. Wilkins.

*Primary Examiner*—Stephen J. Novosad

*Attorney, Agent, or Firm*—William O. Jacobson; Gregory F. Wirzbicki

[57] ABSTRACT

A method for fracturing formations near a shallow horizontal well notches a wellbore at orientations such that later applied hydraulic pressure generates fractures only in preferred directions.

22 Claims, 2 Drawing Sheets

HYDRAULIC FRACTURING OF SHALLOW WELLS

FIELD OF THE INVENTION

This invention relates to drilling, including completing, wells and related apparatus. More specifically, the invention provides an apparatus and method for drilling a well for remediating contaminated zones in a shallow underground formation.

BACKGROUND OF THE INVENTION

The remediation of spills that contaminate an underground zone can require drilling one or more wellbores into the contaminated zone. The wellbores provide a conduit for contaminated fluids to be withdrawn from the formation to the surface for treatment or a conduit for treatment fluids from the surface to be injected into the underground zone. In either case, significant fluid flow within the zone to or from the well must be accomplished, e.g., the zone must be sufficiently porous and permeable to fluid flow.

Although some underground formations have acceptable fluid permeability and porosity, i.e., allow fluid movement within the formation, other formations present significant resistance or barriers to fluid movement. These less permeable formations may require added process steps and measures to allow fluid to be withdrawn or injected, e.g., multiple wells drilled within a formation (i.e., each well having only a limited radial zone of influence within the formation from the wellbore), larger diameter wellbores (to increase cross-sectional flow area at the wellbore face), and high pressure pumps (to overcome a larger resistance to fluid flow).

If these added measures are not sufficient, formation altering methods, such as acidification and fracturing, can be used to increase permeability or otherwise provide improved fluid paths within the formation. Formation altering methods tend to initiate alterations at the wellbore and propagate the alteration outward from the wellbore into the formation.

However, formation altering methods also present major risks. The methods may adversely affect subsequent remediation steps, e.g., allow contaminated fluids to move out of the contaminated zone prior to treatment. The methods may also adversely impact post-remediation uses of the zone, e.g., rupturing a shale barrier which would have tended to contain future spills.

The risks of formation altering are magnified when the contaminated zone is a relatively thin layer located close to the surface, e.g., contaminated fluids in a vadose zone above a potable groundwater table. The added risks include a risk to damage to surface equipment, a risk of unwanted ejection of contaminated fluids at the surface, a risk of damage to or contamination of shallow ground water resources, and a risk of damage to nearby utility conduits buried at shallow depths.

These formation altering risks are still further magnified if these formation altering methods are applied from highly deviated wells, such as horizontal wells, within the vadose zone. The surface rupture risk and/or the risk of propagation out of a thin vadose layer may be especially difficult to avoid over the extended length of a horizontal wellbore.

SUMMARY OF THE INVENTION

Such problems are avoided in the present invention by first creating a stress riser, e.g., a lengthwise notch along the wellbore axis, and injecting controlled amounts of fluid at controlled fluid pressures to the notched wellbore, thus initiating the fractures substantially only at the notches. The controlled fracturing minimizes risks of damage and allows fewer horizontal wells to more effectively remediate a contaminated zone within a shallow underground formation.

The process of fracturing is accomplished be first drilling a deviated wellbore into the contaminated zone from a surface location, i.e., a portion of the wellbore deviates from a vertical direction between the surface location and the underground terminus. In a preferred embodiment, the deviated well portion is oriented in a substantially horizontal plane within a contaminated zone. At least part of the deviated wellbore portion is penetrated by a stress riser such as a lengthwise or longitudinal notch along the wellbore axis. The longitudinal notch may be along any circumferential portion of the wellbore, but the notch preferably avoids the circumferential portion of the wellbore nearest to the surface, e.g., the upper portion of a horizontal wellbore portion. The wellbore portion penetrating the contaminated zone may also be at any depth, but the process is most applicable to a zone at a depth of no more than 3000 feet (914.4 meters). The deviated wellbore portion may also be oriented at any angle, but the process is most applicable to a portion deviated at an average incline angle to the vertical of at least 45 degrees and which extends a distance of at least 10 feet (3.048 meters).

The fracturing fluid, typically including a proppant, is introduced to the notched borehole portion at a pressure which results in initiating fractures at the notch, i.e., the pressure peaks at a fracture initiation pressure. The fractures propagate (typically at reduced pressure) within the formation, preferably avoiding penetration of the surface or other underground zones, while proppant forms in the fractures to minimize closure after the fluid pressure is further reduced. The fluid pressure is then further decreased after a limited amount of fluid is injected and after the fracture has propagated from the stress riser.

BRIEF DESCRIPTION OF THE DRAWINGS

In these Figures, it is to be understood that like reference numerals refer to like elements or features.

DETAILED DESCRIPTION OF THE INVENTION

Figure 1:
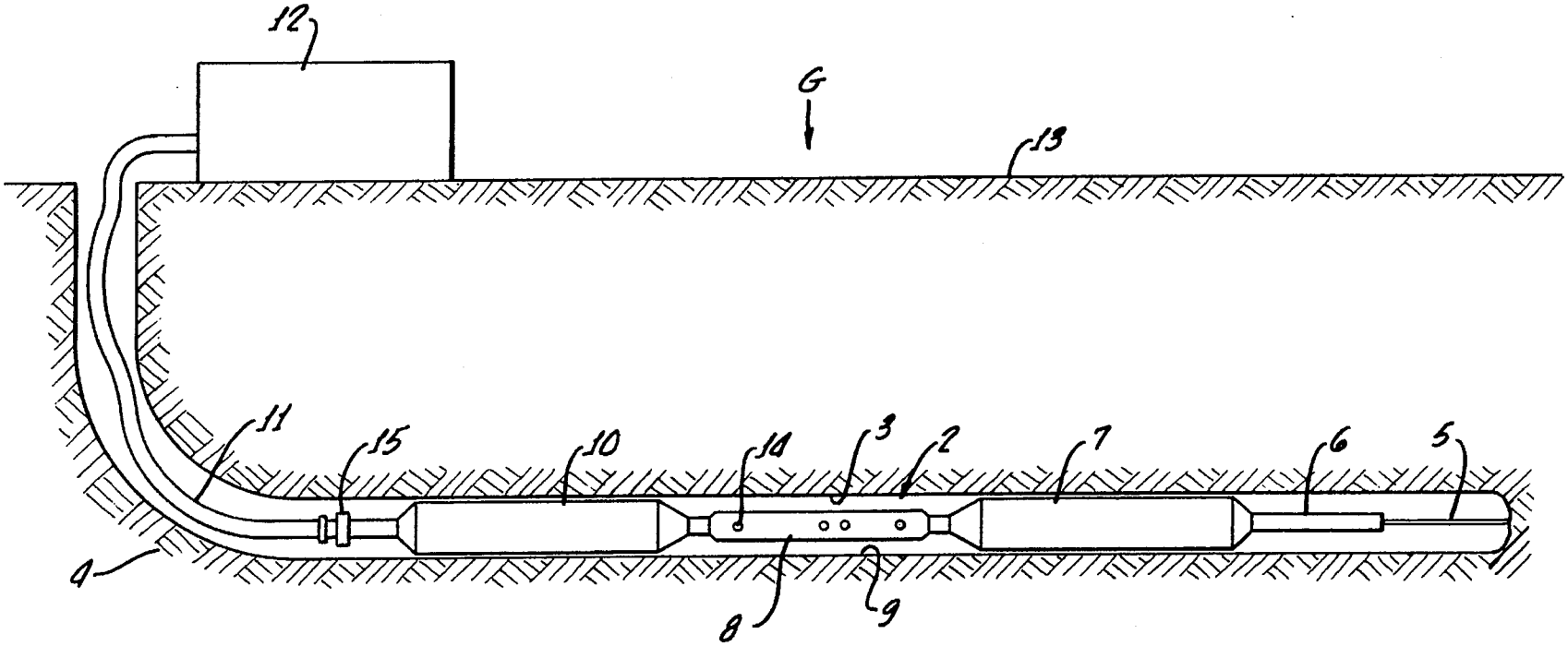
FIG. 1 shows a cross-sectional view of a horizontal wellbore containing a hydraulic fracturing device.

FIG. 1 shows a cross-sectional view of a shallow horizontal well or wellbore 3 containing a tool or apparatus 2 for creating hydraulic fractures from the wellbore into formation 4. The tool 2 comprises a drill assembly 5, a fluid plugging device 6, a first wellbore sealing device 7, a perforated (or perforatable) duct 8, a second wellbore sealing device 10, and a fluid conduit 11 supplied by a source of pressurized fluid 12 located at or near a surface 13. The drill assembly 5 (or tool 2) may also include a locator, such as a radio frequency source (to help locate and guide the assembly during drilling, and fracturing) and a reamer to produce a optimum diameter borehole 3. The tool 2 may also include flow diverters, control valves, step out drilling devices, centralizers, and screens.

Most of the wellbore 3 is shown oriented at an incline angle of about 90 degrees to the vertical ("G"), i.e., a wellbore portion in a nearly horizontal orientation, but the wellbore portion to be fractured does not have to be substantially oriented 90 degrees from the vertical. The process of providing a stress riser (e.g., a lengthwise notch) in the wellbore prior to controlled hydraulic fracturing can also be applied to vertical wells and wells at other deviated angles, i.e., wellbore portions inclined at a non-zero angle from the vertical. Preferably, the notched wellbore portion is deviated at an incline angle ranging between about 45 to 90 degrees, more preferably between about 60 to 90 degrees, and still more preferably between about 75 to 90 degrees from the vertical.

The drilled or excavated wellbore 3 is preferably substantially circular along most of its length, but other cross-sectional geometries are also possible, e.g., undercuts and wellbore intersections with existing fractures. In addition, a wellbore surface including stress risers may also be formed during the drilling, e.g., jet drilling a lengthwise slot while drilling an otherwise circular cross-sectional wellbore. Although the nominal width dimension of the wellbore 3 (e.g., wellbore diameter for a circular wellbore) is theoretically unlimited, it will typically range from about 1 inch to 2 feet for contaminated fluid remediation applications, more preferably from 1 to 12 inches, and most preferably from 1 to 6 inches for shallow, substantially horizontal wellbores.

The portion of wellbore 3 to be fractured is typically located at a shallow depth for shallow spill remediation applications, e.g., in the vadose zone. Although a vadose zone is above the undisturbed level of groundwater saturation, suspended groundwater and moisture may be present in the vadose zone as well as contaminated fluids, e.g., from spills. The portion of the wellbore 3 to be fractured may also be located within a slightly deeper zone of groundwater saturation for remediation of contaminated groundwater applications. The maximum depth of the wellbore portion to be fractured is theoretically unlimited, but the portion hydraulically fractured for these types of remedial applications is typically no deeper than 3000 feet, more typically no deeper than 1000 feet, still more typically no deeper than 500 feet, and still more typically no deeper than 100 feet.

The substantially circular wellbore 3 shown has been previously drilled, preferably jet drilling using fluid discharged from drill assembly 5. Fluid from source 12 is supplied to the drill assembly 5 under pressure to produce a pilot borehole (later reamed) or to produce the wellbore without later reaming. Alternatively, the wellbore 3 can be produced by other conventional means, such as excavating equipment, rotary drilling equipment, explosives, pile or rod driving equipment, and augering. A preferred drill assembly 5 consists of a drill rod assembly supplied by Utilx Corp. located in Kent, Washington.

The drill assembly 5 may also include an orienting means for maintaining the rotational position of the drill assembly within the wellbore 3. If the tool is substantially rigid with respect to rotation, the orienting means can be as simple as controlling and/or monitoring the rotational orientation of the fluid conduit 11 at the surface. Alternatively, the drilling assembly 5 would control the orientation. The orienting means may also be a self- orienting device, e.g., a buoyantly weighted drill rod 5 which circumferentially orients the drill rod when placed in a horizontal or deviated wellbore 3 containing fluids such as drilling muds. Alternatively, other orienting means can be used to orient the tool 2 within wellbore 3 and may be part of the tool 2, such as an electric transmitter and surface receiver or a remote indicator and rotator. The optional drill assembly orienting means may also orient a means for creating a stress riser in wellbore 3, such as a jet drill to produce a lengthwise or longitudinal slot.

Different drilling assemblies 5 can be used for different process steps. For example, a drilling assembly 5 for drilling a borehole may not be the same as the assembly used to slot the borehole or that used to fracture the slotted borehole. Still further, a drilling assembly for excavating a 10 foot deep borehole in a vadose zone can be very different from a rotary drilling assembly used to drill a much deeper borehole. The different assemblies and tools can be run in and out of the wellbore to change configurations, e.g., avoiding the need for an optional shutoff device 6 described as follows.

The optional shutoff device or fluid plug 6 is actuated to restrict pressurized fluid within the assembly 2 from reaching the drill assembly 5 after the wellbore 3 has been drilled. The fluid plug 6 is preferably pressure actuated, e.g., liquid fluid flow is blocked when the pressure is increased beyond a predetermined level, but other actuation means may also be used, such as electrical, mechanical, sonic, or pneumatic. The optional fluid plug 6 may be a reusable valve, e.g., a solenoid valve, or a single action mechanism, such as a plug held by a shear pin above a port so that, when sheared, the plug falls and seals the port. An assembly or tool 2 including the fluid plug 6 is shown as the preferred embodiment, but the optional fluid plug is not essential to producing hydraulic fractures from a shallow horizontal well within a formation, e.g., the perforations 14 may be plugged during drilling and/or the drill rod 5 itself may act as a fluid restrictor allowing most of the fluid supplied by source 12 to flow through the open perforations 14 of the perforated pipe 8.

The first restriction means 7 restricts fluid flow in the annulus between the tool 2 and wellbore 3 prior to hydraulic fracturing and after drilling. The restriction means limits the hydraulic fracturing to only a portion of the wellbore between the two restriction means 7 and 10. The first restriction means 7 is preferably an inflatable packer (including an internal fluid passageway from the perforatable duct 8 to the drill assembly 5). When deflated, the inflatable packer allows circulation of fluids in the wellbore, e.g., during drilling. When inflated, the inflatable packer restricts flow, e.g., during notching and/or hydraulic fracturing. Pressure or other actuation of the inflatable packer can be used. If separate assemblies are used to drill, slot, and fracture the slotted wellbore, many other conventional (first and second fluid) restriction means may also be used, including bob-tail open hole packers, flexible discs, cement plugs, and grout.

A perforated pipe is the preferred perforatable duct 8, but other examples of perforatable ducts included a slotted liner, frangible piping (e.g., scored to rupture and form orifices at predetermined locations when sufficient pressure is applied), tee joints with nozzles, a pipe and gun perforating assembly, perforated piping having frangible seals at the perforations, and an open ended pipe.

The one or more perforations (or other openings) 14 in the perforatable duct 8 are used to deliver fracture fluid or fluid mixture to the isolated wellbore portion to be fractured. As such, at least some of the perforations or openings 14 should be large enough to pass any solid particles in the fracture fluid mixture. At least some of the perforations or openings 14 typically have a minimum cross-sectional dimension or diameter of at least about ¼ inch in order to pass solid particles, more typically at least about ¾ inch, and still more typically at least about 1 inch.

Although a separate slotting step is preferred, at least one of the perforations 14 may also be used as a means to create a stress riser in the wall of wellbore 3, e.g., a perforation can be an orifice or nozzle creating a fluid jetting action cutting a slot into formation 4 as the assembly traverses the wellbore. In order to create a fluid jetting action, a relatively small orifice or nozzle throat diameter is needed, preferably 1/16 inch or less for typical pressures. The stress riser could be jetted using pressurized fracture fluid, or using a separate pressurized fluid, avoiding the risk of proppant plugging. In addition, the stress riser (e.g., slot) can be created by scrapers or protrusions attached to the assembly or other mechanical means.

In the preferred configuration, at least one lengthwise slot 9 is separately cut in the wellbore of formation 4 to act as a stress riser, more preferably two lengthwise slots are cut. Although a single, downwardly positioned slot 9 is shown in FIG. 1, the preferred orientation of the two slots is in a horizontal plane. As shown in cross-section in FIG. 1, the slot 9 is oriented at the lower portion of the wellbore 3 can be in addition to the two slots in a horizontal plane. The slot or slots 9 are preferably cut by perforations such as orifices or nozzles at the sides and bottom of the drill rod 5 and/or perforated pipe 8 (bottom perforations not visible in FIG. 1). The orientation of (nozzled) perforations 14 shown would cut one of the two horizontal slots in the wellbore out of the cross-sectional plane shown in FIG. 1. A similar series of nozzle perforations on the opposite side of the perforated pipe would cut an opposing slot in a horizontal plane.

If the stress riser or slot 9 was previously cut in a separate step (prior to running the assembly shown into the wellbore), the perforations 14 shown only have to supply sufficient amounts of pressurized fluid to the stress riser(s) to initiate one or more fractures at the stress riser(s) and propagate the fracture(s) outward from the wellbore. The side or horizontal orientation of the longitudinal stress riser(s) is especially important for shallow, vadose zone applications where fracture(s) may be required to avoid penetrating the saturated groundwater and the surface. Fractures within the vadose zone may be required to propagate within a thin layer only about a few feet (less than one meter) thick.

A second restriction means 10 also restricts fluid flow in the annulus between the tool 2 and wellbore 3 when hydraulic fracturing occurs. The two restriction means 7 and 10 limit the hydraulic fracturing pressures to only a portion of the wellbore 3 between the two restriction means. Similar to the first restriction means 7, the second restriction means 10 is preferably an inflatable packer, including an internal fluid passageway from the fluid conduit 11 to the perforated pipe 8. The packers allow circulation of fluids during drilling (when deflated) and restrict annular flow when inflated during notching and/or hydraulic fracturing. Pressure or other actuation means for the inflatable packer can be similarly used. Although a drilling means 5 is shown, at least a pilot wellbore is preferably drilled prior to running the assembly 2 with inflatable packers into the wellbore 3.

The fluid conduit 11 is preferably a reinforced flexible hose connecting the source of pressurized fluid 12 to the perforated pipe 8 through the second inflatable packer 10. Other types of fluid conduits can also be used for the fluid conduit, such as drill pipe, tube sections, and coiled tubing. The flexible hose 11 must be capable of withstanding the fluid pressures required to hydraulically fracture the formation at the stress riser and also capable of transmitting a sufficient flow of the pressurized fluid required to drive the hydraulic fracture(s) into the formation. For hydraulically fracturing in a substantially horizontal plane in opposing directions from a nominal 4 inch (10.16 cm) diameter wellbore having two slots about 10 feet (3.048 meters) long and located about 10 feet (3.048 meters) vertically below the surface, at least a 2 inch (5.08 cm) nominal diameter flexible hose is preferred, but the required size is also dependant upon the viscosity, density and composition of the fracture fluid or slurry.

An optional swivel or other connection means 15 is shown between the second packer 10 and the flexible hose 11. If an optional swivel fitting 15 is used, this allows independent orientation of the perforated pipe 8 without limiting the rotary orientation of the flexible hose 11. The swivel 15 precludes circumferential orientation by surface rotation of the fluid conduit 11, but allows a self or other orienting means to circumferentially locate perforations 14 with respect to the wellbore 3. Other types of connection means that may be used include "quick disconnect" fittings, threaded joints, welded joints, adhesive, or other bonded joints.

The source of fluid 12 typically includes a pump or compressor drawing fluid from a lower pressure fluid supply. The fluid being pumped may consist of a water-based drilling fluid or "mud" (during drilling and slot excavation) and a water-based slurry (e.g., a water and proppant mixture) during hydraulic fracturing. Other drilling and/or fracturing fluids can also be used, including oil-based liquids and slurries, air, air-solid mixtures, and inert gases and other fluid-like mixtures. Fracture fluid typically includes viscosity enhancers, such as organic guar gum or cellulose materials, and either natural or man made solid particulates as proppants. The preferred drilling fluid mixture is composed of a biodegradable guar gum, and water, while the preferred fracturing fluid mixture is composed of guar gum, water, sand, and enzyme breakers.

The liquid pump is typically capable of delivering at least about 10 gpm (37.85 liters per minute) of water or a water based mixture (e.g., a slurry) at a pressure of at least about 20 to 100 psig (2.36 to 7.80 atmospheres) for relatively shallow wellbore portions, or about ½ psi (0.34 atmosphere) pressure differential per foot (0.3048 meter) of soil depth below the surface for deeper applications. The pump for the preferred application is preferably a positive displacement mud or grout type Moyno pump supplied by the Moyno Industrial Products Division, Robbins & Myers Inc., located in Springfield, Ohio. Other means for supplying pressurized fluid include: other positive displacement pumps, centrifugal pumps, booster pumps, gas generators, compressed gas cylinders, and compressors. Alternatively, the source of pressurized fluid 12 may also be located downhole rather than on the surface as shown.

Although the pump employed may be capable of delivering greater flowrates, fracture fluid is typically supplied at a controlled flowrate, typically less than 10 gpm (37.85 liters per minute), more typically less than 5 gpm (18.925 liters per minute), most typically 3–4 gpm (11.355–15.14 liters per minute). These controlled flowrates avoid fluid pressure spikes that might produce fractures at locations other than the stress riser or notch location(s).

The process of using the device requires creating at least one stress riser, such as a longitudinal slot, in a wellbore prior to applying sufficient fluid pressure to initiate a hydraulic fracture at the stress riser. A wellbore is first typically drilled at a nominal diameter down to the desired depth and then a substantially deviated or horizontal portion is drilled to penetrate the contaminated fluid zone. The initial downward and substantially horizontal portions of the wellbore may be substantially straight or accurate in shape. The wellbore may also continue beyond the contaminated fluid zone, rising back to the surface. If necessary, the drilling step(s) can be followed by a reaming step to enlarge and/or smooth the wellbore diameter so that inflatable packers can seal or restrict annular fluid flow within the wellbore.

The portion of the wellbore to be fractured (typically a deviated or horizontal portion) is selected, and at least one stress riser is created in the wellbore portion. The stress riser in a shallow horizontal wellbore (e.g., in an application to remediate a vadose zone) is preferably located at other than the top of the wellbore in order to avoid propagating a fracture towards the surface. Other applications in thin layers may require the longitudinal slot(s) to be located at other than the top and bottom portions of the substantially deviated or horizontal wellbore portion.

Although stress risers are preferably relatively straight slots along a length of a horizontal wellbore portion, other geometries of stress risers are also possible. These other geometries include a series (along the wellbore axis) of radially outward pointing penetrations of a nominal wellbore diameter, irregularly shaped slots, partial circumferential undercuts (e.g., extending beyond the nominal wellbore diameter at the bottom and sides, but not at the top or bottom of a horizontal wellbore) at one or more lengthwise locations, and one or more point penetrations of the nominal wellbore in directions having lengthwise and radial components.

The preferred slot is created by fluid jets exiting a drill rod which is translated through the wellbore portion to be hydraulically fractured. The most preferred slot has a V-shaped cross-section with the bottom of the "V" oriented radially outward. The sharpness of the V and tendency to fracture may be further accentuated by mechanical or other means, such as a probe attached to the tool or assembly 2 which is dragged along the bottom of the "V" as the assembly translated across the wellbore portion while a reacting chemical is applied to the slot.

If a single perforation or a single row of perforations is present in the perforated pipe (or drill rod) and more than one slot is desired (e.g., two opposing substantially horizontal slots in the preferred embodiment), the assembly can be repositioned at one end of the wellbore section, reoriented to point the perforation(s) to the desired slot position (e.g., rotated 180 degrees), and the second slot jet excavated as the assembly is translated to the other end of the wellbore section. Alternatively, an oscillatory slot can be excavated if the assembly is partially rotated back and forth as the assembly is translated from one end of the wellbore portion to the other as pressurized fluid is supplied.

Other types of stress risers and means for creating the stress risers are also possible. These include reactive (or absorptive) chemicals applied to a circumferential portion of the wellbore, reactive (or absorptive chemicals) applied to the entire circumference of the wellbore but preferentially reacting with a layer or other portion of the wellbore, directed sonic energy means, electric field generators, pneumatic jets, and mechanical scrapers.

If necessary after slotting, the perforated pipe is then positioned in the wellbore portion and inflatable packers inflated to seal each end of the slotted wellbore portion. The inflatable packers prevent or restrict fluid flow in the annulus between the perforated pipe and the wellbore. At least one of the inflatable packers typically allows fluid flow from a pressurized fluid source to the perforated pipe.

Once positioned for the inflatable packers of the assembly to isolate the desired wellbore portion, the inflatable packers are inflated and fluid pressure at the perforations is slowly increased. The pressure increase is sufficient to initiate hydraulic fractures at the slot or other stress riser, but not so high a pressure increase to generally initiate hydraulic fracturing in the formation. Fluid pressure and flowrate in the wellbore is typically slowly increased until fracturing at the stress riser occurs, allowing additional flowrate into the formation which reduces the rate of pressure rise and prevents more general formation fracturing. Although initiation of fracturing at the stress riser can theoretically occur at wellbore pressures (adjacent to the stress riser) in excess of general formation fracture pressure, initiation typically occurs at a fraction of the general formation fracture pressure, e.g., ranging from about 10 to 99 percent of formation fracture pressure, more typically ranging from about 50 to 90 percent.

The wellbore pressure is maintained at an elevated level (but not necessarily at fracture initiation levels) sufficient to continue the hydraulic fracture into the formation until fracture(s) reach the desired size and/or the risk of damages is unacceptable. This typically requires at least about 60 seconds but no more than 2 hours of elevated fluid pressures, more preferably within a range from about 5 to 60 minutes, and still more preferably within a range from about 5 to 30 minutes. The elevated wellbore pressure during this period can be somewhat larger than formation fracture pressure because of increased frictional resistance to fluid flow through the perforations. Because of frictional losses, wellbore pressure may typically range from about 10 to 150 percent of general formation fracture pressure, but more typically ranges from about 10 to 90 percent of the general formation fracture pressure to initiate fracturing, and significantly less to propagate the fractures.

The hydraulic fracturing fluid is typically a slurry mixture including a solid proppant. A preferred mixture is a water slurry of guar, sodium borate, an enzyme breaker, and fracturing or proppant sand. Although fracturing sand particles are generally preferred, plastic spheres may be preferred in particular applications because of consistency in shape and a density that allows the spheres to be more easily carried along by the water based fluid, e.g., have a neutral buoyancy. An enzyme may also be included in the mixture to digest or breakdown the guar after the fracturing is complete.

Most of the solid particles must be small enough to pass through the perforations or openings in the perforated pipe. The solid particles must also be strong enough to resist fracture closure when the particles are driven or carried into the fractures initiated at the stress riser and the pressure is removed.

For a typical shallow formation, such as a vadose zone remediation application, the wellbore pressure is typically initially increased slowly, e.g., at a nominal pressure rise rate 30 psi/minute. The slow pressure rise rate avoid widespread fracture or other damage to the wellbore. The pressure rise rate typically declines with time and the pressure drops as the fracturing fluid begins to open naturally occurring or fractures at slots propagate, but the pressure rise rate may also increase with time, e.g., when an accumulation of proppant forms a partial blockage. For a slot fracture initiation pressure of about 20 psi (i.e., a maximum wellbore pressure), fluid pressure will then typically decline to about 5 psi during fracture propagation.

At the conclusion of the hydraulic fracture initiation and propagation steps, the pump is typically turned off allowing the pressure to slowly drop. The sand or other solid proppants should form arches or porous fills within the fractures. The arches or porous fills prevent the fracture(s) from closing as the elevated pressure is removed. If the pressure decay rate is unacceptably rapid (e.g., excessive fluid leakoff into a propped open fracture tending to dislodge proppant), the pump may be slowed or otherwise controlled to produce a less rapid pressure decay rate.

Separate well drilling, wellbore slotting and hydraulic fracturing tools are generally preferred for initial drilling, slotting, and fracturing process steps, but a tool capable of accomplishing more than one of these steps has been described and may be preferred in some applications. If separate tools are used, tool removal and insertion process steps are also required.

After fracturing, a conventional PVC or steel well screen is typically pulled into the fractured wellbore portion. The screen minimizes sanding, particulate, proppant, or other solids production if the wellbore is used to remove fluid contaminant. Alternatively, a slotted liner or gravel packing can be used to minimize solids production. Although typical, a well screen or other particulates control means may not be required of some applications, such as air sparging in consolidated formations or low flowrate monitoring boreholes. Well screens or slotted liners may also be required for borehole integrity, such as in shallow vadose zone applications.

EXAMPLE

The invention is further described by the following example which is illustrative of a specific mode of practicing the invention and is not intended as limiting the scope of the invention as defined by the appended claims. The example is derived from testing of a site having thin top asphalt layer covering a clay layer extending down to about 10 feet (3.048 meters) below the surface in a vadose zone. The clay layer was contaminated with gasoline and diesel fuel, presumably from one or more spills. The clay layer had a low permeability which did not allow economical remediation of the spills by conventional vapor extraction techniques. In addition to vertical wells (e.g., for monitoring) and an air sparging well, two horizontal wells HB-2 and HB-3 were drilled into the clay layer, one fractured and one unfractured. The drilling of both horizontal wells was similar, using FlowMole® technology supplied by Utilx Corporation, located in Kent, Washington. Both horizontal wells were located about 40 feet apart and were started on the eastern portion of the contaminated zone and penetrated the zone in a westerly direction, i.e., the horizontal portions were generally parallel. The drilling and fracturing of HB-2 is described here in more detail.

After penetrating the top asphalt layer covering the shale layer, the FlowMole® assembly (having a 1 inch or 2.54 cm nominal diameter fluid jet drill rod) was used to drill a 2 inch (5.08 cm) diameter pilot hole a distance of about 72 feet (21.95 meters) which was later reamed and hydraulically fractured. The initial 2 inch (5.08 cm) nominal diameter pilot hole portion was drilled down at a 16 degree angle to a depth of about 5 feet (1.524 meters), continued at about the 5 foot (1.524 meter) depth for about 50 feet (15.24 meters) before angling upward and exiting at the surface. Upon exiting the surface, a nominal 4 inch (10.16 cm) diameter reamer was attached to the drill rod and a 4 inch (10.16 cm) nominal diameter borehole was created as the attached reamer was backed out.

A high pressure water jet was then connected to a fluid supply and attached to the assembly. Slots were created in the borehole as the water jet was pulled back through the borehole. Water pressure was applied and removed such that three 10 foot (3.048 meter) long slots were created at an approximate mid- horizontal plane location within a plane including the wellbore centerline.

A fracturing apparatus similar to that shown in FIG. 1 was then attached to the drill rod and translated through the borehole. The perforated pipe 8 (as shown in FIG. 1) was a 10 foot (3.048 meter) long, 2 inch (5.08 cm) nominal diameter perforated pipe with a plurality of about 1 inch (2.54 cm) diameter perforations. The perforations were drilled randomly to be oriented at many radial directions when the assembly was in the borehole. The perforated pipe was supplied with a fracture fluid pressurized by a truck-mounted model CG 555 grout pump supplied by Chem-Grout, located in Grange Park, Ill. The pump was supplied by fluid from a 30 gallon mixing tank. The fluid conduit 11 connecting the pump to the second inflatable packer was a nominal 2 inch (5.08 cm) diameter high pressure fire hose.

Once the fracturing apparatus was positioned adjacent to the slots in the borehole, the 30 gallon tank was filled (and/or refilled) with a guar solution, sodium tetraborate, and potassium carbonate. The mixture was stirred until a thick slurry was obtained, at which time either sand or plastic pellets were slowly added until a homogenous slurry resulted. The packers were then inflated to isolate a slotted portion. The maximum fluid pressure and amount of fluid injected (approximately 150 gallons) were selected as sufficient to cause desirable horizontal fracturing at the slot, but not so large as to produce a large risk of surface rupture or general formation fracturing.

Immediately prior to the commencement of pressurization sufficient to fracture the slotted borehole, a high pH activity hemicellulase enzyme was added to the mixture to form a biodegradable solution to break down the guar. The mixture was then injected at a pressure of approximately 20 psig (2.36 atmospheres).

Different amounts of the solution were injected into the formation at each of the three fracture (slotted wellbore portions) locations. Fluid was injected at fracture #1 location until bypassing of fluid past the packers was observed. For fracture location #2, the maximum (preselected) amount of fluid was injected. For fracture location #3, the fluid was injected until pressure at the outlet of the grout pump indicated plugging of the perforated injection pipe, i.e., the pump dead headed. During fluid injection at each of the fracture locations, the horizontal extent of fracture propagation was monitored by measuring ground surface rise as a function of time. This was accomplished by surveying a series of yardsticks with a manual level instrument.

Fracture location #1 injected about 90 gallons of a slurry mixture (of which about 30 gallons were sand particles) when significant bypassing of the packers was noted and wellbore pressure was reduced. Fracture location #2 injected about 150 gallons of which about 50 gallons were sand particles before the wellbore pressure was reduced. Fracture location #3 injected about 25 gallons of a solution containing ABS plastic particles before deadhead pressure was observed and the pump shut off.

Figure 2:
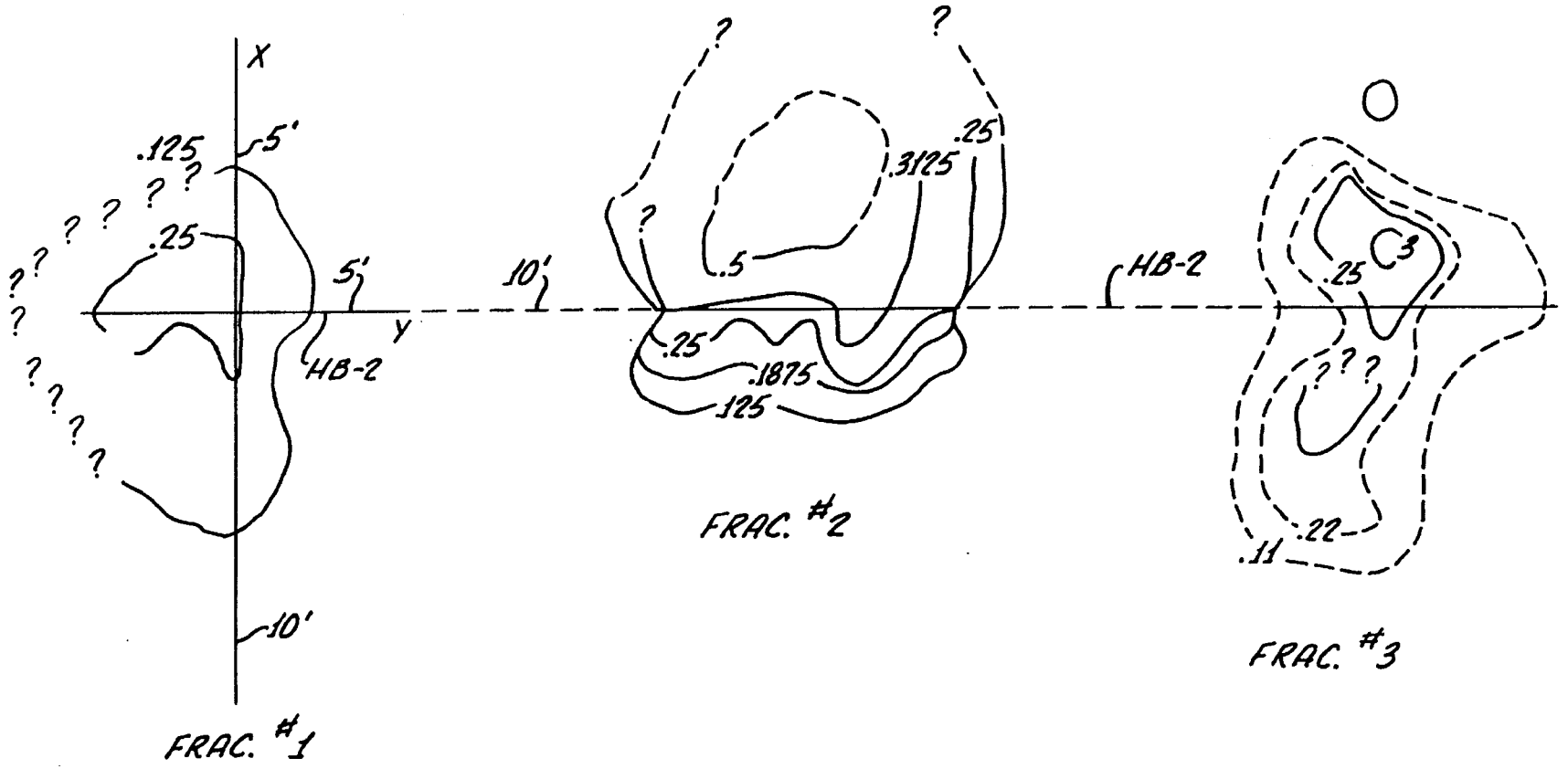
FIG. 2 shows a plan view of surface rise contours resulting from fracturing a horizontal well at a site illustrated in the example hereinafter discussed.

FIG. 2 depicts the final surface rise contours (in inches) for all three fracture locations in a plan view. HB-2 represents the location of the horizontal wellbore, shown solid where slotted and dotted where not slotted.

As shown on FIG. 2, solid contour lines of surface rise represent essentially measured locations and dotted contour lines represent interpolated or estimated contours or surface rise. Incomplete contour lines with question marks (?) represent unknown portions of a contour.

On the contours at the Fracture #1 location, an X–Y axis with horizontal distances noted has been superimposed. The shape, size of the contours, amount of rise, and the lack of surface ruptures caused by hydraulically fracturing a horizontal borehole about 5 feet (1.524 meters) deep show that predominantly horizontal fractures were created. Although not shown for clarity, some of these fractures intersected vertical wells which may have also affected the contours and the shape and size of the horizontal fractures.

Further information on the apparatus used for this example and other related information are disclosed in a paper entitled "Use of Horizontal Wells for Environmental Remediation," by Brian Kelly, Jeff Koepke, Mo Ghandehari, Brent Chaffee, Carl Flint, and Huyen Phan, presented to the HazMat West '93 Conference in Long Beach, Calif., in November 1993, the teachings of which are incorporated herein by reference.

Alternatively, the lengthwise notching (or other preferential stressing of a circumferential portion of a deviated well and limited hydraulic fracturing of the portion can be applied to water well, gas and oil production wells, injection wells, solution or other mining bores, and soil vent wells. The invention may also be applied to the injection from slotted and fractured wellbores of impermeable barriers, such as "settable" liquids forming a barriers to the flow of contaminated fluids, or ad/adsorptive compounds and mixtures to treat soil and contaminated groundwater insitu. Still other embodiments include adding a partial circumferential pressure barrier (such as a plastic film at the top of the wellbore) to further assure initial fracturing only at the stress riser and adding an automatic process controller of wellbore pressure based on sensed variables during fracturing.

While the preferred embodiment of the invention has been shown and described, and some alternative embodiments also shown and/or described, changes and modifications may be made thereto without departing from the invention. Accordingly, it is intended to embrace within the invention all such changes, modifications and alternative embodiments as fall within the spirit and scope of the appended claims.

What is claimed is:

1. A process for hydraulically fracturing a shallow underground formation comprising:

excavating a wellbore extending along an axis from a surface location to an underground location horizontally displaced from said surface location, a portion of said wellbore being located in an underground formation substantially above a zone of saturated groundwater;

forming a notch in the formation substantially along the axis of said wellbore portion in a substantially deviated portion of said wellbore located said zone;

introducing an amount of a fluid mixture to said wellbore portion after notching at a fluid pressure which causes a fracture to initiate into said formation at said notch; and decreasing said fluid mixture pressure.

2. The process of claim 1 wherein said wellbore portion is no more than 500 feet deep and which also comprises the step of reaming said wellbore prior to said notch forming step.

3. The process of claim 2 which also comprises the steps of:

obtaining formation permeability related data prior to said introducing step; and estimating the extent of hydraulic fracturing using a model of said formation zone and formation permeability related data.

4. The process of claim 3 which also comprises the step of calculating the amount of introduced fluid mixture required to fracture said estimated extent of hydraulic fracturing.

5. The process of claim 4 which also comprises the step of measuring an indicator of said amount of fluid mixture introduced in said introducing step.

6. The process of claim 5 wherein said pressure decreasing step is initiated within 2 minutes of when said measuring indicator indicates a majority of said amount of fluid has been introduced.

7. The process of claim 6 which also comprises the step of orienting said notch such that said notch is at other than the top of said highly deviated wellbore portion.

8. The process of claim 7 wherein said fluid mixture comprises water and solid particles.

9. A process for remediating an underground formation containing a contaminated groundwater, said process comprising:

excavating a wellbore extending along an axis from a surface location to an underground location horizontally displaced from said surface location, a portion of said wellbore being located in an underground formation substantially within a zone of contaminated groundwater;

forming a notch in the formation substantially along the axis of said wellbore portion in a substantially deviated portion of said wellbore located in said contaminated groundwater zone;

introducing an amount of a fluid to said wellbore portion after notching at a fluid pressure which causes a fracture to initiate into said formation at said notch; and decreasing said fluid pressure.

10. A process for fracturing an underground formation containing contaminated water comprising:

excavating a conduit extending along an axis from a surface location to a zone within an underground formation;

creating a longitudinal notch in the formation at a depth and first peripheral position in said conduit at a location whereby said notch produces a higher maximum formation stress than a second peripheral position at said axial location when substantially equal fluid pressures are applied to said peripheral positions; and introducing a fluid-like substance to said peripheral positions for substantially selectively initiating a fracture at said first peripheral location.

11. A process for fracturing an underground formation comprising:

excavating a conduit wall extending along an axis from a surface location to a zone within an underground formation;

creating a stress riser at a first peripheral position in said conduit wall at an axial location which produces a higher maximum formation stress than a second peripheral position at said axial location when substantially equal fluid pressures are applied to said peripheral positions; and introducing a fluid-like substance to said peripheral positions for substantially selectively initiating a hydraulic fracture at said first peripheral location, wherein said underground formation is a vadose zone and said borehole is substantially deviated from a vertical direction.

12. An apparatus for remediating an underground formation containing water and fracturing the underground formation along a portion of a deviated wellbore in the formation having an axis and a non-circular pressure stress riser in the formation that extends substantially parallel to said axis, said apparatus comprising:

a fluid conduit extending from a surface location to an underground location proximate to said stress riser when placed in said deviated wellbore;

a packer attached to said fluid conduit which is capable of substantially restricting axial fluid flow in the annulus between said fluid conduit and said wellbore; and means for introducing an amount of fluid to said wellbore portion at a pressure sufficient to selectively initiate a fracture proximate to said stress riser in the formation while minimizing the initiation of substantial fracturing at other locations within the wellbore portion.

13. An apparatus for fracturing an underground formation along a portion of a deviated wellbore having an axis and a pressure stress riser that extends substantially parallel to said axis, said apparatus comprising:

a fluid conduit extending from a surface location to an underground location proximate to said stress riser when placed in said deviated wellbore;

a packer attached to said fluid conduit which is capable of substantially restricting axial fluid flow in the annulus between said fluid conduit and said wellbore;

means for introducing an amount of fluid to said wellbore portion at a pressure sufficient to selectively initiate a fracture proximate to said stress riser while minimizing the initiation of substantial fracturing at other locations within the wellbore portion;

a second packer attached to said fluid conduit wherein said stress riser is located between said packers when said apparatus is placed in said wellbore portion;

means for rotationally orienting said fluid conduit; and a source of pressurized fluid connected to said fluid conduit.

14. The apparatus of claim 13 which also comprises:

means for controlling the flowrate, amount, and pressure of said fluid; and means for supplying and mixing solid particles with said fluid.

15. An apparatus for hydraulically fracturing an underground formation from a borehole penetrating said formation along an axis, said apparatus comprising:

a fluid conduit extending from a surface location to an underground location;

means for creating a non-circular pressure stress riser extending substantially parallel to said axis in said formation, wherein said means for creating is attached to said fluid conduit and said pressure stress riser is non-circular in shape; and means for introducing fluid to said underground location at a pressure sufficient to initiate a hydraulic fracture proximate to said stress riser.

16. The apparatus of claim 15 which also comprises means for limiting fluid flowrate to less than 10 gpm.

17. The apparatus of claim 16 which also comprises means for limiting the amount of fluid introduced.

18. The apparatus of claim 17 which also comprises means for orienting said apparatus within said borehole.

19. The apparatus of claim 18 which also comprises a second means for creating a second pressure stress riser in said wall, wherein said second means is also attached to said fluid conduit and said second pressure stress riser is non-circular in shape and oppositely located from said first pressure stress riser.

20. The process of claim 10 wherein said fluid-like substance comprises air.

21. The process of claim 10 wherein said fluid-like substance comprises a proppant.

22. The process of claim 21 wherein said proppant comprises plastic spheres.

* * * * *

UNITED STATES PATENT AND TRADEMARK OFFICE

CERTIFICATE OF CORRECTION

PATENT NO. : 5,472,049

DATED : December 5, 1995

INVENTOR(S) : Chaffee et al.

It is certified that error appears in the above-indentified patent and that said Letters Patent is hereby corrected as shown below:

Column 11, Claim 1, line 50, after "located" and before "said" insert -- above --.

Signed and Sealed this

Seventh Day of May, 1996

Bruce Lehman

*Attest:*

BRUCE LEHMAN

*Attesting Officer*

*Commissioner of Patents and Trademarks*